United States Patent [19]

Spitzke

[11] 4,199,165

[45] Apr. 22, 1980

[54] SKATEBOARD SKID ACCESSORY

[75] Inventor: Arthur Spitzke, Troy, Mich.

[73] Assignee: Matrix Corporation, Oxford, Mich.

[21] Appl. No.: 926,832

[22] Filed: Jul. 21, 1978

[51] Int. Cl.[2] ..... A63O 17/02

[52] U.S. Cl. ..... 280/87.04 A; 280/11.2

[58] Field of Search ..... 280/11.2; 280/87.04 A

[56] References Cited

U.S. PATENT DOCUMENTS

| | | | |
|---|---|---|---|
| 2,595,751 | 5/1952 | Balstad | 280/11.2 X |
| 2,631,861 | 3/1953 | Daniska | 280/11.2 |
| 2,644,692 | 7/1953 | Kahlert | 280/11.2 X |

FOREIGN PATENT DOCUMENTS

| | | | |
|---|---|---|---|
| 1029590 | 5/1966 | United Kingdom | 280/11.2 |

*Primary Examiner*—Richard A. Bertsch
*Assistant Examiner*—Milton L. Smith
*Attorney, Agent, or Firm*—Fisher, Gerhardt, Crampton & Groh

[57] ABSTRACT

A skid accessory for skateboards adapted to be mounted at the end of the board between the wheel supporting trucks and the end of the board to protect the board from engagement with the ground and to act as a braking device by frictional engagement with the ground.

9 Claims, 4 Drawing Figures

SKATEBOARD SKID ACCESSORY

This invention relates to land vehicles such as skateboards and more particularly to a skid member which protects the skateboard from excessive wear and acts as a brake member.

The board portions of skateboards are subjected to substantial wear particularly at opposite ends because the ends are frequently brought into engagement with the ground during performance of acrobatics by tilting the board about one or the other of its axles. Such wear appears primarily at the rear of the board.

Skid members have been provided for skateboards which tend to wear excessively and when worn must be discarded.

It is an object of the invention to provide a skid member for skateboards which acts to protect the board from excessive wear.

Another object of the invention is to provide a skid member for skateboards having a configuration which enhances the braking effect resulting when the skid member is brought into engagement with the ground.

Still another object of the invention is to provide a skid member for skateboards which is reversible to present a new wear surface thereby extending useful life of the skid member.

The objects of this invention are accomplished by providing a skid member for skateboards which is in the form of a body member adapted for mounting to the underside of the skateboard with the body member having a semi-cylindrical surface such that the axis of curvature of the surface is disposed transversely to the board and generally parallel to the ground on which the skateboard is to be operated. The semi-cylindrical surface is provided with parallel spaced rib members which also extend parallel to the axis of curvature of the semi-cylindrical surface. The ribs are formed to project generally perpendicular to the bottom of the skateboard surface on which the skid member is to be mounted.

These and other objects of the invention will become apparent from the following description and from the drawings in which.

Figure 1:
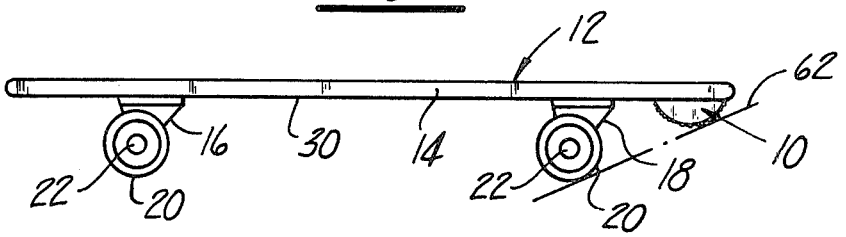
FIG. 1 is a side elevation of a skateboard showing a skid member embodying the invention.
Figure 2:
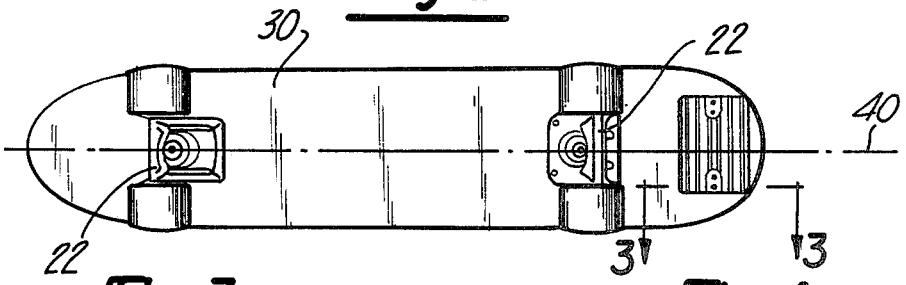
FIG. 2 is a bottom view of the skateboard seen in FIG. 1.

A skid member or accessory for skateboards embodying the invention is designated generally at 10 and is shown in FIGS. 1 and 2 as supported from the underside of a skateboard 12. The skateboard 12 includes a board member 14 supported for forward and rearward truck assemblies 16 and 18, respectively. Each of the truck assemblies includes a pair of wheels 20 rotatable on axles 22 disposed substantially transversely to the board member 14.

The skid member 10 has a unitary body member preferably made of a high density plastic material. The body member is a longitudinal segment of a cylinder having a semi-cylindrical surface 26 with the axis of curvature of the surface 26 extending substantially transversely to the board member 14. The skid member 10 has a flat mounting surface 28 formed on the chord of said semi-cylindrical surface that is adapted to engage the lower surface 30 of the board 14.

Figure 3:
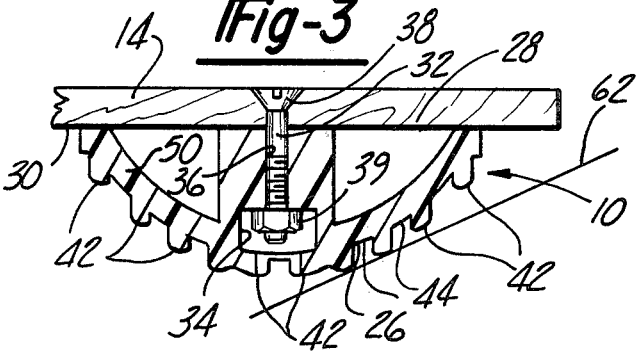
FIG. 3 is a cross sectional view at an enlarged scale of the skid member taken on line 3—3 in FIG. 2.
Figure 4:
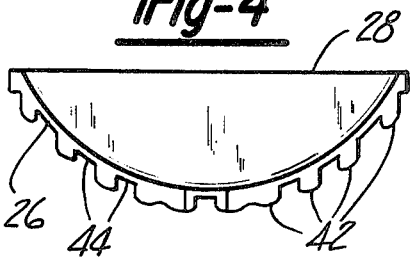
FIG. 4 is an end view of the skid member seen in FIG. 3.
Figure 5:
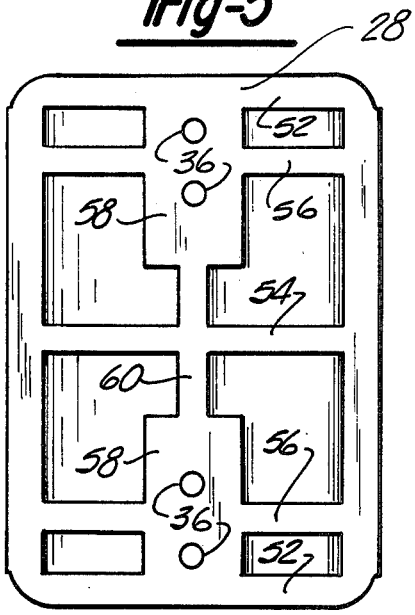
FIG. 5 is a top view of the skid member.
Figure 6:
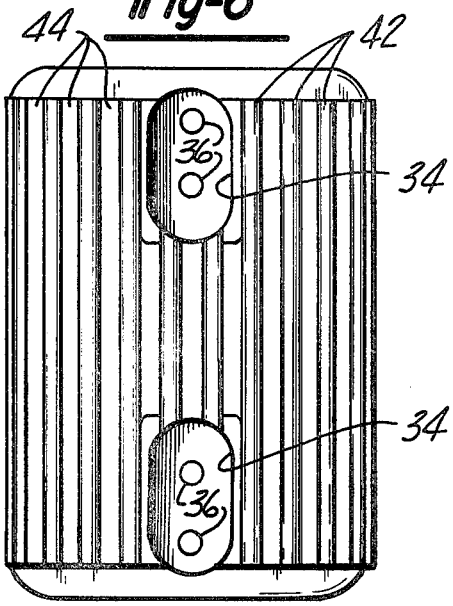
FIG. 6 is a bottom view of the skid member.

The skid member 10 is held in the attachably fixed position at the underside of the board member 14 by means of a pair of bolts 32 one of which is associated with each end of the skid member 10. As seen in FIG. 3, the skid member 10 is provided with a pair of recesses 34 in the surface 26 adjacent opposite ends of the skid member 10 and each of the recesses 34 is provided with a pair of openings 36. The pair of bolts 32 are adapted to pass through a selected one of the openings in each of the recesses 34 and as seen in FIG. 4 the bolts 32 preferably have a flat head 38 seated in a counter sunk portion in the top surface of the board member 14. The skid member 10 is maintained in position by nuts 39 engaged with the bolts 32 and disposed in the recesses 34. The two pair of openings 36 in the pair of recesses 34 are disposed symmetrically relative to the center line of the board member 14 which is indicated at 40 and affords a selected mounting arrangement for different spacing of openings in the skateboards.

The semi-cylindrical surface 26 of the skid member 10 is provided with a plurality of ribs 42 which project downwardly in substantially perpendicular relationship to the lower surface 30 of the board member 14 as best seen in FIG. 3. The rib members 42 and the alternate grooves 44 are disposed to extend substantially parallel to the axis of curvature of the semi-cylindrical surface 26.

As seen in FIGS. 3 and 4, the cylindrical surface 26 is formed on the exterior of a semi-cylindrical wall 50 of substantially uniform thickness. Also end walls 52, a middle wall 54 and intermediate walls 56 extend transversely to the axis of the semi-cylindrical wall and serve to reinforce the skid accessory 10. The cavities formed by the walls 52, 54 and 56 permit the skid member 10 to maintain its strength and at the same time reduce its weight and material content to make the skid member economical to form. The top surfaces of the walls 52, 54 and 56 as well as the top surface of the enlarged portions 58 and connecting wall 60 form the mounting surface 28 which engages the bottom of the skateboard 14.

Referring now to FIG. 3, when skid member 10 is placed in operation, the skateboard 12 is caused to pivot about the axis of the adjacent axle 22 so that one or more of the ribs 42 is brought into engagement with the ground surface on which the skateboard is being operated and which is indicated in FIGS. 1 and 3 by the line 62. Under that condition it will be noted that the ribs 42 are disposed at an angle to the surface 62 which enhances the braking characteristics of the skid member 10.

After a period of use the ribs 42 in the ground contacting area become worn and if desired new ribs 42 may be brought into position for engagement with the ground by temporarily detaching the skid member 10, revolving the member end for end and refastening the bolts 32.

A skid accessory for skateboards has been provided which is adapted to be fastened to the underside of the skateboard between the ground engaging wheels and the adjacent end of the board. The skid member has a semi-cylindrical surface with its axis of curvature disposed transversely to the direction of movement of the skateboard and the surface is formed with rib members which when engaged with the ground are disposed at an angle enhancing the braking effect of the skid member. After ribs become worn in one ground engaging area, the skid member can be reversed to present another ground engaging surface.

The embodiments of the invention in which an exclusive property or privilege is claimed are defined as follows:

1. A skid accessory for a skateboard having an elongated board supported in substantially horizontal, elevated position by front and rear sets of ground engaging wheels, the combination comprising; a body member adapted to be mounted at an underside of said board, said body member having a semi-cylindrical surface with its axis of curvature extending transversely and parallel to said board, and rib members formed in said surface and extending parallel to said axis for movement into engagement with the gound upon tilting of said board relative to one of said sets of wheels, said body member having a flat mounting surface disposed in a plane facing oppositely from said semi-cylindrical surface and said ribs depending from said semi-cylindrical surface prependicular to said flat mounting surface.

2. The combination of claim 1 wherein said body member has an attaching portion disposed in a plane passing through the axis of curvature of said semi-cylindrical surface and disposed perpendicular to said flat mounting surface.

3. The combination of claim 2 wherein said semi-cylindrical surface is disposed symmetrically relative to said attaching portion.

4. The combination of claim 1 wherein said body member has an attaching portion disposed symmetrically relative to forward and rearward edges of said body member and wherein said body member is reversible to present a new wear surface to one side of said plane.

5. The combination of claim 2 wherein said attaching portion includes recesses in said semi-cylindrical surface and bolt receiving openings in said recesses communicating with a mounting surface facing oppositely from said semi-cylindrical surface.

6. A skateboard comprising; a board member, a pair of trucks each supporting a pair of wheels, said trucks being mounted adjacent opposite ends of said skateboard, a skid member mounted at the underside of said board between one end of said skateboard and the adjacent truck, said skid member having a semi-cylindrical surface with the axis of curvature of said surface extending substantially parallel to said axle of said rear truck, and rib members extending parallel to said axis and perpendicular to the underside of said board.

7. The combination of claim 6 wherein said skid member has attaching portions disposed symmetrically relative to the center line of said board member and to said axis of curvature and means connecting said complementary attaching portions to each other.

8. The combination of claim 6 wherein said semi-cylindrical surface is formed on a curved wall of substantially uniform thickness and wherein a plurality of spaced walls extend transversely of said axis and are formed integrally with the interior of said curved wall.

9. The combination of claim 6 wherein said skid member is made of plastic material.

* * * * *